United States Patent [19]

Costa et al.

[11] Patent Number: 4,594,013

[45] Date of Patent: Jun. 10, 1986

[54] SHEET FEED DEVICE FOR A PRINTER OR TYPEWRITER

[75] Inventors: Jorge Costa; Wolfgang Reichel, both of Yverdon, Switzerland

[73] Assignee: Hermes Precisa International S.A., Yverdon, Switzerland

[21] Appl. No.: 616,146

[22] Filed: Jun. 1, 1984

[30] Foreign Application Priority Data

Jun. 3, 1983 [CH] Switzerland ..... 3059/83

[51] Int. Cl.[4] ..... B41J 11/58; B41J 13/10

[52] U.S. Cl. ..... 400/625; 271/3; 271/9; 400/629

[58] Field of Search ..... 400/624–629; 271/3, 9

[56] References Cited

U.S. PATENT DOCUMENTS

| | | | |
|---|---|---|---|
| 1,817,235 | 8/1931 | Chenery | 400/626 |
| 4,275,968 | 6/1981 | Irwin | 271/3 X |
| 4,473,314 | 9/1984 | Imaizumi | 400/625 |
| 4,502,805 | 3/1985 | Humbs | 400/625 X |

FOREIGN PATENT DOCUMENTS

| | | | |
|---|---|---|---|
| 42673 | 4/1981 | Japan | 400/625 |

*Primary Examiner*—Paul T. Sewell

*Attorney, Agent, or Firm*—Groff & O'Brien

[57] ABSTRACT

The sheet feed device (1) comprises several cassettes (13) on which the sheets are stacked, a removal mechanism associated with each of the supports, intended to remove a sheet from the cassette (13) and introduce it into the printer (2), and a selection mechanism (55) intended to activate one of the removal mechanisms. The mechanisms for removal and selection (55) are driven by the platen (3) of the printer (2). The selection mechanism (55) makes use of the position occupied by the mobile carriage (4). The latter carries a drive part (61) that can work with a set of selection levers (56). These levers (56) are equal in number to the removal mechanism. Depending on the position of the carriage during selection, one or the other of the levers (56) is put into active position and moved by a drive wheel (65) to activate a removal control element (76) and to start the removal and introduction processes. The device has the advantage that the platen (3) is driven in only one direction during a complete cycle of selection, removal and introduction of a sheet in the printer.

6 Claims, 3 Drawing Figures

SHEET FEED DEVICE FOR A PRINTER OR TYPEWRITER

This invention relates to a sheet feed device for a printer or typewriter with a mobile carriage comprising a frame, one or more supports on which the paper to be printed is stacked, a removal mechanism associated with each of the supports, intended to remove a sheet from the support for its introduction in the printer, and a selection mechanism intended to activate one of the removal mechanisms.

This design is already known from German patent DE No. 2.950.707. The device described in that patent comprises a selection mechanism driven by the platen making it possible to activate one of the paper removal mechanisms by driving the platen first over a predetermined distance in a first direction opposite the introduction of the paper, reversing the driving direction over a short predetermined distance, then again driving the platen in the first direction to make the sheet advance to the platen and a third time reversing the drive direction of the platen to introduce the paper into the printer. To perform one cycle for introduction of a sheet into the printer, the device requires multiple reversals of the direction of rotation of the drive of the device, which makes drive control complicated. Furthermore, when a sheet introduced into the printer is partially printed and the operator wants to complete or correct a previously written line, the device described in the German patent permits going back only a few lines, otherwise one of the removal mechanisms is driven to cause a sheet to advance toward the printer which can disturb the operation of the device.

This invention has as its object to create a device that performs a selection cycle for removal and introduction of paper that does not require any reversal of the drive direction of the platen. For this purpose, the device is characterized in that the selection mechanism comprises a detection device that can work with the mobile carriage to determine the position that it occupies, this detection device comprising at least a drive element intended to activate one of said removal mechanisms as a function of the position occupied by the carriage. According to the invention, the selection criteria of the removal mechanism therefore consists of the position occupied by the mobile carriage during the selection phase.

The accompanying drawing represents, by way of example, an embodiment of the device, object of the invention.

Figure 1:
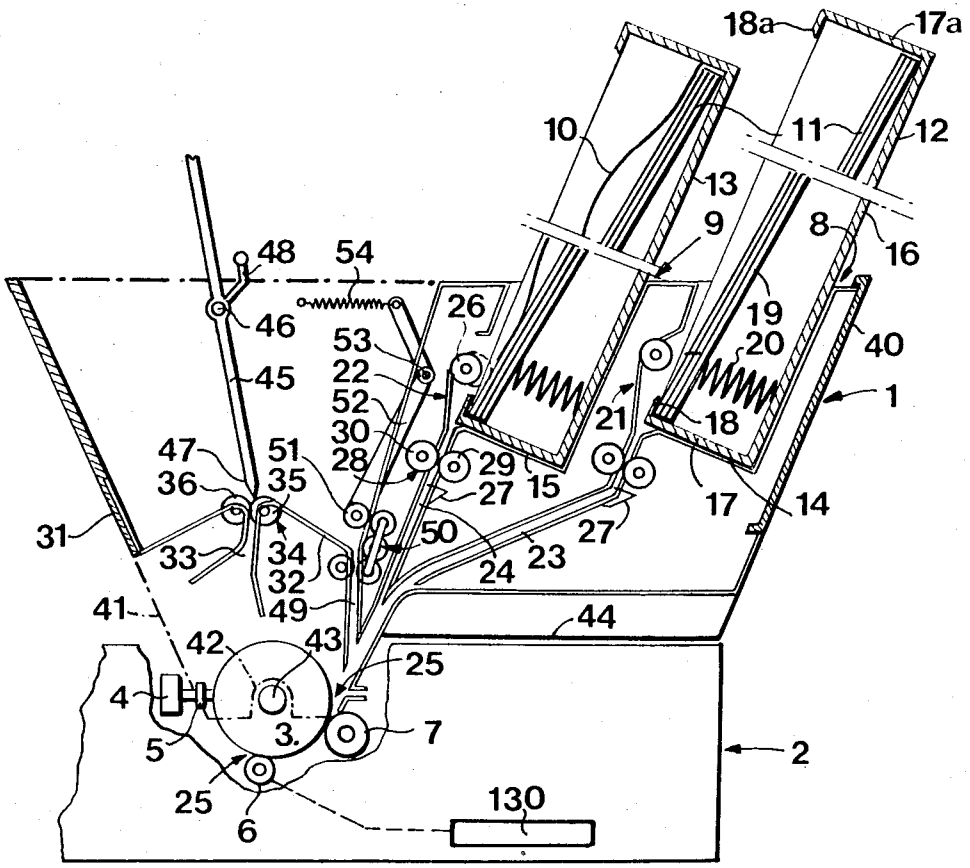
FIG. 1 is a side view in section showing the entire unit mounted on a printer.

With reference to FIG. 1, sheet feed device 1 is mounted on a printer 2 or a typewriter comprising a platen 3 and a mobile carriage 4 that can move along the platen and carrying a writing device 5 such as a dot matrix head or a daisy wheel. A drive shaft 6 connected to a drive motor, preferably a stepping motor, not shown, drives platen 3. Counterpressure rollers, only one of which, 7, is represented, are pulled elastically against the platen and constitute a drive mechanism 25 making it possible to make a sheet of paper, introduced into the printer, advance in a known way.

Feed device 1 comprises a frame 40 whose side walls 41 exhibit notches 42 fitting on shaft 43 of platen 3. Base 44 of the frame rests on the back part of printer 2, Feed device 1 comprises supports 8 and 9 on which sheets 11 to be printed are stored. These supports comprise cassettes 12 and 13 that can be placed on holding plates 14, 15 and can be removed from these positions. Cassettes 12, 13, rectangular in shape, comprise a bottom 16 and side walls 17, 17*a*. These latter have holding elements 18, 18*a* in their upper part in the form of rims intended to hold sheets 11 placed on a support plate 19. This plate 19 is pulled in its lower part by a spring 20 in the direction of holding elements 18. At its upper part plate 19 is held approximately in contact with bottom 16.

A removal mechanism 21, 22, is associated with each of supports 8, 9 and serves to shift and remove the top sheet from the stack of sheets 11 and to transport it by a channel 23, 24 to paper drive device 25. As described in detail below, this mechanism is made to transport the sheet upwards with the aid of a roller 26. The lower edge of the sheet is then disengaged from holding elements 18 and the sheet, hitting against upper wall 17*a*, of the cassette, forms a pocket 10. Roller 26 then drives the sheet in the opposite direction. The lower edge passes above holding elements 18 and pocket 10 is eliminated. Roller 26 is then disengaged from the sheet which falls freely against an alignment stop 27. A transport device 28, consisting of two rollers 29, 30, is then activated to introduce the sheet in a controlled fashion into printer 2 where it is taken by drive device 25.

Device 1 further comprises two supports 31 and 32 intended to store the printed sheets. After printing, these sheets pass into exit channel 33 where they are carried by transport device 34 also consisting of two drive rollers 35 and 36 to be placed in normal order on support 31 or in reverse order on support 32. Wall 45 separating the two supports is mounted for this purpose to swing around a pivot 46. A handle 48 allows this wall 45 to be locked in a given position. Lower edge 47 of wall 45 exhibits two guide surfaces guiding the sheets as they exit channel 33 either to the left on support 31 or to the right on support 32.

Support 32 can also be used as a support for feeding envelopes or sheets to be printed. It has for this purpose, in its lower part, a channel 49 suitable for guiding the envelopes toward platen 3. A removal mechanism 50 is placed at the lower part of support 32 and permits shifting and carrying of the lowest envelope of a stack placed on support 32. The stack of envelopes is held by rollers 51 placed on a crossbar fastened to one end of a bent lever 52 mounted to rotate around a pivot 53. Rollers 51 are pulled by a spring 54 in the direction of the back wall of support 32. In case the support is used as a container for the sheets already printed, rollers 51 rest on this wall in such a way as to obstruct entry from channel 49.

Figure 2:
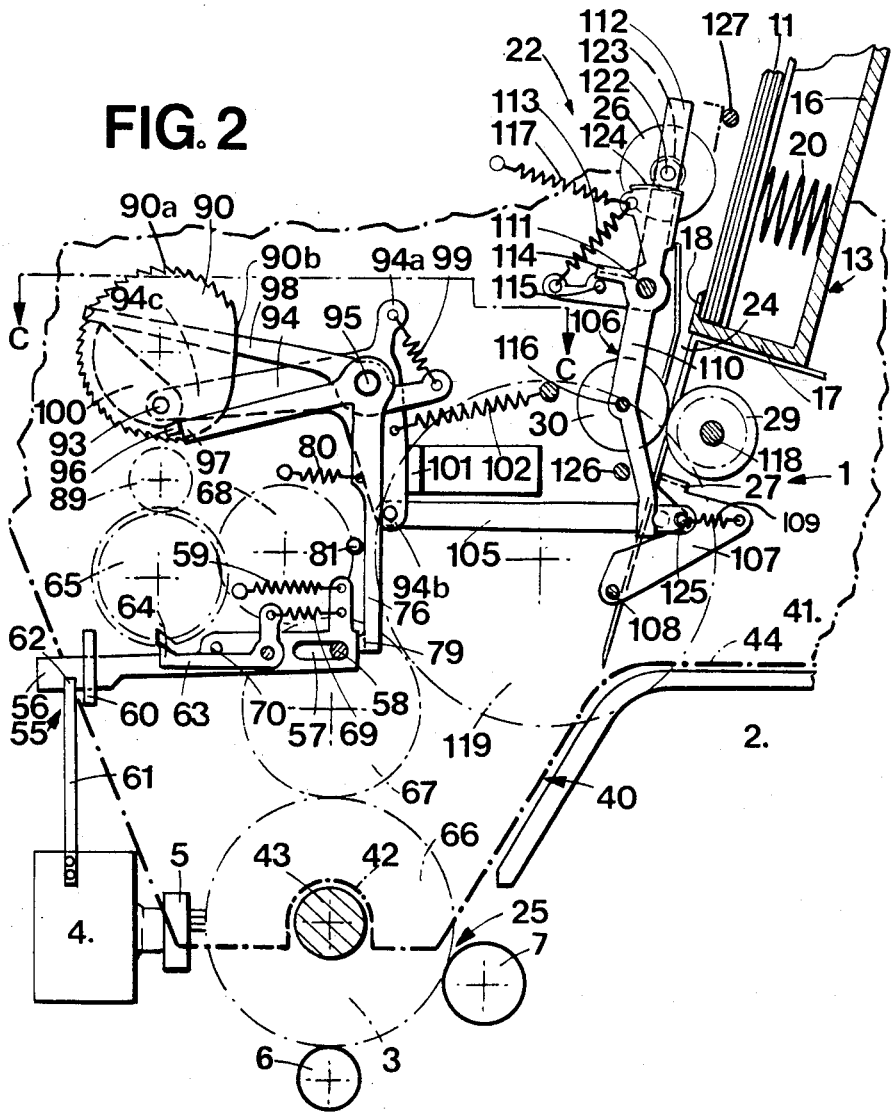
FIG. 2 is a side view illustrating the features of the device.
Figure 3:
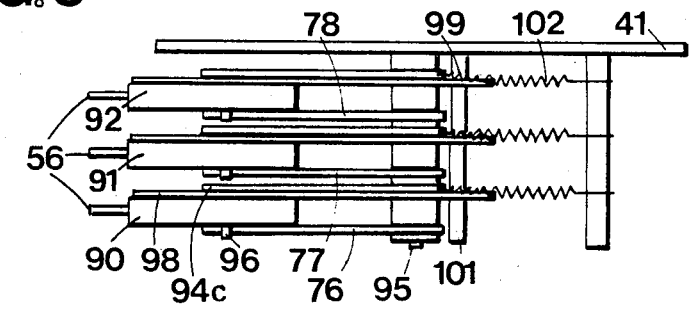
FIG. 3 is a top view along C—C of FIG. 2.

With reference to FIGS. 2 and 3, the feed device comprises a selection mechanism 55 intended to activate at the user's choice one of removal mechanisms 21, 22, 50. This selection mechanism 55 comprises a detection device consisting of a set of levers comprising a number of selection levers 56 equal to the number of removal mechanisms 21, 22, 50. Each of levers 56 comprises an opening in which a stationary shaft 58 is engaged. Each of selection levers 56 is, therefore, able to rotate around shaft 58 and be displaced longitudinally along opening 57. A small plate 60 solid with frame 40 has slots to guide levers 56. These latter are pulled by a spring 59 in a rest position and comprise a ratchet 63 mounted to rotate on lever 56. Ratchets 63 have a tooth that can work with a toothed wheel 65, and they are pulled by a spring 69 against a stop 70 carried by levers 56. The mechanism includes a toothed wheel 65 driven by platen 3 by gearing 66 and 68 to turn in the opposite direction to platen 3.

A drive part 61 is rigidly fastened to carriage 4 and comprises a rounded upper part 62 that can work with only one of levers 56 at a time so as to rotate the latter around shaft 58 from an inactive position to an active one in which tooth 64 engaged the teeth of toothed wheel 65 to be moved to the right in FIG. 2.

The feed mechanism comprises, in association with each of levers 56, a removal control part such as rockers 76 and 78. These rockers are mounted to rotate on a shaft 95 and are pulled by a spring 80 against a rest stop 81. Through one of their ends 79 they work with corresponding drive lever 56. One counterclockwise rotation of one of rockers 76 and 78 starts the corresponding removal mechanism.

Each of the removal mechanisms associaied with the paper supports comprises a cam 90 to 92. This cam is mounted to rotate around an eccentric pivot 93 placed at one of the ends **94*c* of a bent arm 94 that can rotate around shaft 95. A stop 96 solid with cam 90 works with end 97 of rocker 76 to prevent cam 90 from swinging around pivot 93. A spring 102 pulls bent arm 94 against a stationary stop 101 so that the periphery of cam 90 occupies a position close to the periphery of a toothed wheel 89, but does not touch this periphery when end 97 is in contact with stop 96. Each of the removal mechanisms also comprises a lever 98 mounted to rotate around the shaft 95. This lever 98 is pulled by a spring 99, set between lever 98 and projection 94*a* of bent arm 94, against a part 100 solid with cam 90 to rotate cam 90 when end 97 is disengaged from stop 96**.

The periphery of cam 90 comprises a first portion **90*a* consisting of teeth that can work with toothed wheel 89 driven by wheel 65 and a second smooth portion 90*b* that can slide on this toothed wheel 89 under the action of spring 102**.

The other end **94*b* of bent arm 94 is coupled to a pullrod 1O5 controlling the sheet separation means and the positioning of alignment stop 27. This alignment stop consists of a comb-shaped part fastened between two arms 107 rotating around a shaft 108 fastened to the frame. A pin 125 solid with pullrod 105 is connected by a spring 109 to one of arms 107**.

Separation means 106 comprise, in the proximity of two side walls 41 of frame 40, a lever 110 mounted on a shaft 111 fastened to the frame and a bracket 112 also rotating around shaft 111. Lever 110 and bracket 112 are connected by a spring 113 pulling bracket 112 to a rest position determined by two stops 114 and 115 carried by lever 110 or bracket 112. Roller 30 of the removal mechanism is mounted to rotate on a shaft 116 held by levers 110. A spring 117 pulls levers 110 into such a position that roller 30 remains in contact with roller 29 fastened to a shaft 118 mounted on bearings solid with the frame. This shaft 118 is driven by platen 3 by gear 66, 67, 119 so that roller 29 and platen 3 turn in the opposite direction.

Roller 26 comprises a shaft 122 mounted on brackets 112. A toothed wheel 123 solid with shaft 122 works with a toothing 124 in the form of a segment of a circle carried by one end of one of levers 110. The other end of this lever 110 is made to work with pin 125 solid with the pullrod 105 to control a rotating of lever 110 around shaft 111. The device further comprises a stop 126 intended to fix the exact position of alignment stop 27 during its positioning and of stops 127 to limit the rotating of bracket 112 around shaft 111.

Rollers 26, 29, and 30 are covered with elastomer to assure friction drive of the sheets of paper. The sheet feed device can be adapted to any printer or typewriter with a control unit 130 that can precisely control the drive of the platen.

It is obvious that the set of levers 56 has to be placed opposite a portion of the platen not used for printing. These levers 56 are, therefore, advantageously mounted opposite the right end of the platen outside the usual writing area in an area called the selection area.

The device functions as follows. When printer control unit 130 receives the order to introduce a given type of sheets stacked on supports 8, 9, and 32, it orders the movement of the carriage to the selection area so that part 61 causes one of levers 56 to rotate around shaft 58 in the active position. Tooth 64 of ratchet 63 then works with toothed wheel 65. Platen 3 is then driven in the direction of the introduction of the paper. Lever 56 is pulled to the right in FIG. 2, it drives rocker 76 which disengages from stop 96.

In pressing on part 100, arm 98, pulled by spring 99, causes cam 90 to rotate, which, because of its eccentricity, comes in contact with toothed wheel 89. The latter is driven in the same direction as platen 3 and drives cam 90 in rotation. Pullrod 105 is then moved a first time toward the left in FIG. 2 and successively controls the following operations:

Positioning of alignment stop 27.

Rotating of lever 110 and bracket 112 around shaft 111, until bracket 112 comes in contact with stop 127.

Lever 100 continues its rotating movement and, by means of gears 123, 124, drives roller 26 to the left; in contact with the top sheet contained in cassette 13, this roller moves this sheet by friction upward over a distance of about a centimeter to disengage the lower edge of the sheet from under holding elements 18 of cassette 13, and to form pocket 10 (see FIG. 1).

Cam 90, at this moment, has made a rotation of 180° and begins to move the pullrod to the right, controlling the following operations:

Lever 110 rotates in the opposite direction, driving roller 26 to the right, the latter carries the sheet of paper over elements 18 downward.

When the pocket is entirely reabsorbed and the sheet has been laid flat, roller 26 disengages from the sheet which falls freely on alignment stop 27.

Control unit 130 at this moment causes the drive motor to stop for about one second to assure that this fall occurs without hindrance.

After this fall and the start of the drive motor, smooth periphery **90*b* comes in contact with wheel 89** and slides over it.

Control unit 130 causes another stop of the drive motor. During this stop, lever 110, pulled by spring 117, continues to rotate to allow closing of the two drive rollers 29 and 30. The pullrod 105 then causes the retraction of alignment stop 27 under the effect of the pull of spring 102 acting on arm 94. Toothed periphery **90*a* then again comes in contact with toothed wheel 89**.

The drive motor is started for a period which is a function of the desired length of introduction of paper and controlled by unit 130. During this operation, cam 90 is driven by wheel 89 and bent arm 94 comes in contact with rest stop 101.

Lever 98, pulled by spring 99, presses on part 100 separating cam 90 a short distance from drive wheel 89, and its stop 96 comes in contact with end 97 of rocker 76.

During selection and removal of a sheet from a given cassette and its introduction into the printer, the platen is driven in only one direction.

The two stops of the drive motor controlled by unit 130 assure an unhindered drop of the paper and a locking of drive rollers 29, 30 in an immobile position of the sheet. Of course, these two stops are not essential if the shape of cam 90 is chosen so that the paper has sufficient time to drop on alignment stop 27 before roller 30 presses on roller 29 so that stop 29 is immediately retracted after the contact of the two transport rollers 29, 30.

Since pocket 10 is entirely reabsorbed before the sheet of paper can drop on alignment stop 27, the drop occurs normally. Transport mechanism 28 takes this sheet in a predetermined position to introduce it in a controlled fashion into the printer, thus assuring an exact positioning of the sheet on platen 3.

We claim:

1. A sheet feed device for a printer or typewriter having a driven platen and a carriage on which a writing device is mounted, comprising a frame having a plurality of supports adapted to support a stack of sheets to be printed, a sheet removal mechanism associated with each of said supports for removing a sheet from the stack for its introduction into the printer, drive means operatively connected between the printer platen and the sheet removal mechanism, and a selection mechanism operatively connected to said carriage for selectively actuating one of said sheet removal mechanisms; said selection mechanism comprising a drive member connected to said carriage, and lever means operatively connected to each sheet removal mechanism, whereby the drive member engages a selected lever means depending upon the position of the carriage to thereby actuate a selected sheet removal mechanism for removing a sheet from the respective stack.

2. A sheet feed device according to claim 1, wherein the lever means includes a plurality of levers corresponding to the number of sheet removal mechanisms.

3. A sheet feed device according to claim 2, wherein each sheet removal mechanism includes a removal control element operatively connected to each lever upon engagement by said drive member.

4. A sheet feed device according to claim 3, wherein the drive means operatively connected between the printer platen and the sheet removal mechanism includes a drive element operatively connected to each lever for driving the corresponding removal control element.

5. A sheet feed device according to claim 4, wherein the drive element comprises a toothed wheel and tooth means on each lever engageable with said toothed wheel upon engagement by the drive member on the carriage.

6. A sheet feed device according to claim 5, wherein the tooth means comprises a ratchet pivotally mounted on the lever, a stop fixedly mounted on said lever, and spring means biasing said ratchet in a direction toward said toothed wheel against said stop.

* * * * *